US009670438B2

(12) United States Patent
Christensen et al.

(10) Patent No.: US 9,670,438 B2
(45) Date of Patent: Jun. 6, 2017

(54) COMPOSITION AND METHOD FOR THE TREATMENT OF SUNSCREEN STAINS IN TEXTILES

(71) Applicant: Ecolab USA Inc., St. Paul, MN (US)

(72) Inventors: Stephen B. Christensen, Inver Grove Heights, MN (US); Jessica R. Bull, South St. Paul, MN (US); Kirsten M. Weeks, Minneapolis, MN (US); Dawn N. Lock, Inver Grove Heights, MN (US); Joanna Ai Pham, Blaine, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 14/993,316

(22) Filed: Jan. 12, 2016

(65) Prior Publication Data

US 2016/0222329 A1 Aug. 4, 2016

Related U.S. Application Data

(60) Provisional application No. 62/109,528, filed on Jan. 29, 2015.

(51) Int. Cl.

| | |
|---|---|
| ***C11D 1/83*** | (2006.01) |
| ***C11D 3/33*** | (2006.01) |
| ***C11D 7/08*** | (2006.01) |
| ***C11D 17/06*** | (2006.01) |
| ***C11D 11/00*** | (2006.01) |
| ***C11D 3/08*** | (2006.01) |
| ***C11D 3/20*** | (2006.01) |

(52) U.S. Cl.

CPC ..... *C11D 11/0017* (2013.01); *C11D 1/83* (2013.01); *C11D 3/08* (2013.01); *C11D 3/2075* (2013.01); *C11D 3/2086* (2013.01); *C11D 3/33* (2013.01); *C11D 17/06* (2013.01)

(58) Field of Classification Search

CPC .. C11D 1/83; C11D 3/124; C11D 3/33; C11D 3/361; C11D 3/362; C11D 7/08; C11D 11/0017; C11D 17/06; C11D 17/0065

See application file for complete search history.

(56) References Cited

U.S. PATENT DOCUMENTS

| | | | | |
|---|---|---|---|---|
| 4,618,914 | A | 10/1986 | Sato et al. | |
| 4,830,773 | A | 5/1989 | Olson | |
| 5,221,496 | A | 6/1993 | Holland | |
| 5,306,444 | A | 4/1994 | Kitamura et al. | |
| 5,369,126 | A | 11/1994 | Doran et al. | |
| 5,454,237 | A | 10/1995 | Pellerin | |
| 5,739,094 | A * | 4/1998 | Bowman | C11D 1/667 510/327 |
| 5,763,412 | A | 6/1998 | Khan et al. | |
| 5,858,941 | A | 1/1999 | Oakes et al. | |
| 5,919,745 | A | 7/1999 | Cala et al. | |
| 5,968,893 | A * | 10/1999 | Manohar | C11D 3/0021 510/475 |
| 5,986,118 | A | 11/1999 | Fehr et al. | |
| 5,998,358 | A | 12/1999 | Herdt et al. | |
| 6,004,922 | A | 12/1999 | Watson et al. | |
| 6,015,784 | A * | 1/2000 | Kazuta | C11D 1/146 264/118 |
| 6,225,485 | B1 | 5/2001 | Bertz et al. | |
| 6,274,541 | B1 | 8/2001 | Man | |
| 6,290,732 | B1 | 9/2001 | Hei et al. | |
| 6,350,725 | B1 | 2/2002 | Levitt et al. | |
| 6,425,959 | B1 | 7/2002 | Man | |
| 6,479,453 | B2 | 11/2002 | Man | |
| 6,897,188 | B2 | 5/2005 | Gohl et al. | |
| 6,903,060 | B1 | 6/2005 | Dykstra et al. | |
| 7,037,884 | B2 | 5/2006 | Man | |
| 7,863,237 | B2 | 1/2011 | Rigley et al. | |
| 7,971,302 | B2 | 7/2011 | Poy et al. | |
| 7,998,278 | B2 | 8/2011 | Hackenberger et al. | |
| 8,287,658 | B2 | 10/2012 | Miralles et al. | |
| 8,361,950 | B2 | 1/2013 | Man et al. | |

(Continued)

FOREIGN PATENT DOCUMENTS

| | | | |
|---|---|---|---|
| CA | 1 226 782 | | 9/1987 |
| EP | 0 825 250 | A1 | 2/1998 |
| WO | 99/50380 | * | 10/1999 |
| WO | WO 99/50380 | | 10/1999 |
| WO | WO 2007/004622 | A1 | 1/2007 |
| WO | WO 2012/036700 | | 9/2010 |
| WO | WO 2011/056935 | | 5/2011 |
| WO | WO 2013/032493 | | 3/2013 |

OTHER PUBLICATIONS

International Search Report and Written Opinion for PCT/US2013/055279), mailed Nov. 11, 2013.

(Continued)

*Primary Examiner* — Charles Boyer

(74) *Attorney, Agent, or Firm* — Merchant & Gould P.C.

(57) ABSTRACT

A composition having a pH of less than 7 and including one or more surfactants, one or more chelating agents, and one or more acid in an aqueous solvents is used to treat stains on a textile caused by sunscreen lotion. Sunscreen stains in textiles can be reduced to a Δb* of 5 or less as compared to the textile before staining. The method includes preparing a use solution having a pH of less than 7 by applying to the wash solution a solid composition comprising about 15 to about 60 wt-% of surfactants; about 4 to about 18 wt-% chelating agents; and about 10 to about 40 wt-% of an acid or a salt thereof, and washing the textile in the wash solution, where the method is capable or reducing the stain in the textile to a Δb* of 7 or less as compared to the textile before staining.

17 Claims, No Drawings

(56) References Cited

U.S. PATENT DOCUMENTS

| | | | | |
|---|---|---|---|---|
| 8,569,220 | B2 | 10/2013 | Gaudreault | |
| 8,758,520 | B2 | 6/2014 | Monsrud et al. | |
| 2002/0151452 | A1 | 10/2002 | Bullock et al. | |
| 2002/0187910 | A1 | 12/2002 | Speed et al. | |
| 2003/0216273 | A1 | 11/2003 | Mitra et al. | |
| 2004/0028794 | A1 | 2/2004 | Van Buuren et al. | |
| 2004/0254090 | A1 | 12/2004 | Lentsch et al. | |
| 2005/0153859 | A1 | 7/2005 | Gohl et al. | |
| 2006/0111261 | A1* | 5/2006 | Sadlowski | C11D 1/83 510/221 |
| 2006/0205628 | A1 | 9/2006 | Deinhammer et al. | |
| 2006/0211593 | A1 | 9/2006 | Smith et al. | |
| 2007/0033702 | A1 | 2/2007 | Hsu | |
| 2008/0015133 | A1 | 1/2008 | Rigley et al. | |
| 2008/0276973 | A1 | 11/2008 | Miralles et al. | |
| 2009/0011971 | A1 | 1/2009 | Evers | |
| 2009/0119847 | A1 | 5/2009 | Arai et al. | |
| 2009/0264329 | A1 | 10/2009 | Underwood et al. | |
| 2010/0170303 | A1 | 7/2010 | Gohl et al. | |
| 2010/0229897 | A1 | 9/2010 | Miralles et al. | |
| 2011/0107527 | A1 | 5/2011 | De Buzzaccarini et al. | |
| 2011/0251116 | A1* | 10/2011 | Aehle | A23K 1/1653 510/374 |
| 2011/0296626 | A1 | 12/2011 | Poy | |
| 2012/0023680 | A1 | 2/2012 | Poy et al. | |
| 2012/0129751 | A1 | 5/2012 | Miracle et al. | |
| 2013/0192006 | A1 | 8/2013 | Tinker et al. | |
| 2014/0165294 | A1 | 6/2014 | Wilker et al. | |
| 2014/0186922 | A1* | 7/2014 | Estell | C11D 3/386 435/221 |
| 2014/0349372 | A1* | 11/2014 | Erlandsen | C12N 9/20 435/198 |

OTHER PUBLICATIONS

Beggs "Tunnel Washer or Extractors: What's the Proper Choice? (Part 1)" Jul. 22, 2016.

Gurtler Industries, Inc., "Technical Service Report" Hibiclens® Antiseptic Skin Preparation (2008), http://www.regentmedical.com/americas/hibiclens_laundry.html.

International Search Report and Written Opinion, dated May 26, 2016, (PCT/US2016/012928).

Süd-Chemie AG, "Tonsil® Highly Active Bleaching Earths", 10 pages.

* cited by examiner

COMPOSITION AND METHOD FOR THE TREATMENT OF SUNSCREEN STAINS IN TEXTILES

CROSS-REFERENCE TO RELATED APPLICATIONS

This application is a non-provisional application of U.S. Application Ser. No. 62/109,528, filed Jan. 29, 2015, the disclosure of which is incorporated in its entirety.

FIELD

The present disclosure relates to a composition and method for removal of stains from textiles. In particular, the present disclosure relates to a composition and method for removal of stains caused by sunscreen containing avobenzone or oxybenzone.

BACKGROUND

Many popular sunscreen formulations, particularly those designated "full spectrum," contain components such as avobenzone or oxybenzone. Avobenzone and oxybenzone are aromatic ketones that are used to block UV rays. Avobenzone is effective at blocking the full spectrum of UVA radiation, whereas oxybenzone can be used to block UVB and short-wave UVA radiation. However, when avobenzone and/or oxybenzone are absorbed onto or into textiles (e.g., bath or beach towels, clothing, sheets, upholstery, etc.) and are subsequently washed, they may cause yellow stains that are difficult to remove. In particular, it has been reported that when textiles are washed in an alkaline wash solution, especially when using chlorine bleach, yellow stains appear to be "set" by the high pH and chlorine. Further, if the wash solution contains iron, reaction with avobenzone and/or oxybenzone can cause the stains to become orange. Attempts to remove such stains with typical combinations of detergent, detergent boosters, and bleach have not been successful. Some prior art methods have used acidic detergents with phosphoric acid to remove avobenzone stains. However, for a number of environmental reasons, phosphoric acid is not a sustainable component in laundry operations. Further, such acidic methods typically use a very low pH, which may damage textiles if the acid is not adequately removed by rinsing prior to machine drying. It is against this background that the present disclosure is made.

SUMMARY

Stains caused by sunscreen lotion on a textile can be treated with a composition having a pH of less than 7 and including one or more surfactants, one or more chelating agents, and one or more acids in an aqueous solvent. The method is capable of reducing sunscreen stains in textiles to a $\Delta b^*$ of 5 or less as compared to the textile before staining. The method includes preparing a use solution having a pH of less than 7 by applying to the wash solution a solid composition comprising about 15 to about 60 wt-% of surfactants; about 4 to about 18 wt-% chelating agents; and about 10 to about 40 wt-% of an acid or a salt thereof, and washing the textile in the wash solution, where the method is capable or reducing the stain in the textile to a $\Delta b^*$ of 7 or less as compared to the textile before staining.

A concentrate composition for treating sunscreen stains may comprise about 15 to about 60 wt-% of surfactants; about 4 to about 18 wt-% chelating agents; and about 10 to about 40 wt-% of an acid or a salt thereof; and can be formulated as a solid.

DETAILED DESCRIPTION

Ordinary combinations of detergents (e.g., surfactant systems, typically alkaline), detergency boosters, and bleach have been found to be inefficient in removing yellow or orange stains caused by sunscreen ingredients on textiles. Without wishing to be bound by theory, it is hypothesized that active acidic hydrogens on oxybenzone and avobenzone react with the active components in an alkaline wash solution, forming salts that are highly colored. Combination with iron in the wash water can form even more deeply colored (e.g., orange) complexes. Other components of sunscreen compositions may also contribute to the staining.

The present disclosure provides compositions and methods for the removal of stains from textiles caused by sunscreen containing avobenzone and/or oxybenzone. The composition may also be useful for removing other stains bound to the textiles by a similar mechanism, such as certain other phenyl-containing compounds, such as ethylhexyl salicylate, homosalate, or polybiguanides (e.g., chlorhexidine). The compositions and methods of the present disclosure are capable of minimizing or eliminating yellow or orange stains caused by avobenzone and/or oxybenzone on textiles that have been set in an alkaline wash. The compositions can be provided as a liquid or as a flowable solid, optionally packaged in unit dose form. The compositions can be conveniently used in industrial scale or smaller operations, such as small businesses and homes.

The present compositions can be used to treat (e.g., to pre-treat, de-stain, or wash) various surfaces. In particular, the compositions can be useful for treating textiles and textile or fiber-covered surfaces, including towels, clothing, sheets, upholstery, carpets, rugs, etc. The composition can be provided as a concentrate that can be solubilized and/or diluted into a use solution. For convenience of packaging and use, the composition may be provided as a solid. A solid composition according to the present disclosure may encompass a variety of forms including, for example, blocks, pellets, tablets, granules, or powder. In a preferred embodiment, the composition is provided as a flowable solid (e.g., a powder or granules) that can be used in domestic or commercial washing machines.

In some embodiments, the composition can be provided as a complete detergent composition, comprising detersive components in addition to stain removing components. A detergent composition may include, for example, an effective amount of cleaning agent to provide soil removal, solidification agent for binding the composition, and branched fatty acid disintegrator to provide improved dissolution of the solid detergent composition into aqueous use solution. The cleaning agent can include any component that is compatible with the stain removing components and that provides soil removal properties when dispersed or dissolved in an aqueous solution and applied to a substrate for removal of soil from the substrate. Alternatively, the composition can be provided as a booster or a separate stain treatment (e.g., a pretreatment to laundry or re-wash treatment).

According to an embodiment, the composition comprises at least one surfactant, one or more chelating agents, and a source of acidity. In certain embodiments, the composition comprises a surfactant or surfactant system, an organic acid (such as a carboxylic acid), a chelating agent, a solidification agent, and optionally other functional ingredients. In some embodiments, the solidification agent is inorganic in nature. In certain embodiments, the composition includes citric acid or another solid acid.

According to an embodiment, the composition comprises a surfactant or a surfactant system. The term "surfactant system" refers to a mixture of at least two surfactants. Suitable surfactants include water-soluble or water-dispersible nonionic, anionic, cationic, amphoteric, and zwitterionic surfactants and their combinations.

Nonionic surfactants useful in compositions include those having a polyalkylene oxide polymer as a portion of the surfactant molecule. Such nonionic surfactants include, for example, chlorine-, benzyl-, methyl-, ethyl-, propyl-, butyl- and other alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the tradename Pluronic® (available from BASF Corp. in Florham Park, N.J.); and other like nonionic compounds. Silicone surfactants such as the ABIL® B8852 (available from Evonik Degussa Corp. in Cincinnati, Ohio) can also be used. Examples of commercially available alcohol alkoxylates include Dehypon® LS-54 ($R\text{-}(EO)_5(PO)_4$) and Dehypon® LS-36 ($R\text{-}(EO)_3(PO)_6$) (available from BASF); and of capped alcohol alkoxylates, Plurafac® LF221 (available from BASF) and Tegotens® EC11(available from Evonik Degussa).

The composition may further comprise one or more semi-polar nonionic surfactants. Suitable semi-polar nonionic surfactants include, for example, phosphine oxides, sulfoxides and their alkoxylated derivatives.

Anionic surfactants useful in the compositions include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like. Preferred anionics are sodium alkylarylsulfonate, alpha-olefinsulfonate, and fatty alcohol sulfates.

Surface active substances are classified as cationic if the charge on the hydrotrope portion of the molecule is positive. In theory, cationic surfactants may be synthesized from any combination of elements containing an "onium" structure $R_nX^+Y^-$— and could include compounds other than nitrogen (ammonium) such as phosphorus (phosphonium) and sulfur (sulfonium). In practice, the cationic surfactant field is dominated by nitrogen containing compounds. Cationic surfactants useful for inclusion in a cleaning composition include amines, such as primary, secondary, and tertiary monoamines with C12-C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl(C12-C18) dimethylbenzyl ammonium chloride, n-tetradecyldimethylbenzyl-ammonium chloride monohydrate, a naphthalene-substituted quaternary ammonium chloride such as dimethyl-1-naphthylmethylammonium chloride, and the like.

Amphoteric, or ampholytic, surfactants contain both a basic and an acidic hydrophilic group and an organic hydrophobic group. Typical functional groups in amphoteric surfactants include a basic nitrogen group and an acidic carboxylate group. In some amphoteric surfactants the negative charge is provided by a sulfonate, sulfate, phosphonate, or phosphate group.

Amphoteric surfactants can be broadly described as derivatives of aliphatic secondary and tertiary amines, in which the aliphatic radical may be straight chain or branched and where one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes: acyl/dialkyl ethylenediamine derivatives (e.g. 2-alkyl hydroxyethyl imidazoline derivatives) and their salts, and N-alkylamino acids and their salts.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Zwitterionic surfactants that can be used in the composition include betaines, sultaines, imidazolines, and propionates.

Because the composition may be intended to be used in an automatic clothes washing machine or another machine, such as a carpet cleaner, the surfactants can be selected so that they result in an acceptably low level of foaming when used inside the machine. Typically low-foaming or non-foaming surfactants are preferred. In addition to selecting low foaming surfactants, defoaming agents can be utilized to reduce the generation of foam.

According to embodiments, the composition may comprise the surfactant or surfactant system at a concentration of about 10 to about 75 wt-%, or about 15 to about 60 wt-%, or about 20 to about 50 wt-%, or about 25 to about 40 wt-%, or about 28 to about 35 wt-% of surfactants. In an exemplary embodiment, the composition comprises about 25, 30, or 35 wt-% surfactants, such as a mixture of anionic and nonionic surfactants.

According to an embodiment, the composition comprises a chelating agent. Any suitable chelating agent can be selected, such as a phosphate, phosphonate, amino-carboxylate, or combination thereof. Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphonic acid, diethylenetriaminepenta (methylenephosphonic acid), 1-hydroxyethane-1,1-diphosphonic acid CH3C(OH)[PO(OH)2]2, aminotri(methylenephosphonic acid) N[CH2PO(OH)2]3, aminotri(methylenephosphonate), 2-hydroxyethyliminobis (methylenephosphonic acid) HOCH2CH2N[CH2PO(OH)2]2, diethylenetriamine penta(methylenephosphonic acid) (HO)2POCH2N[CH2CH2N[CH2PO(OH)2]2]-2, diethylenetriaminepenta(methylenephosphonate), sodium salt C9H(28-x)N3NaxO15P5 (x=7), hexamethylenediamine(tetramethylenephosphonate), potassium salt ClOH(28-x)N2KxO12P4 (x=6), bis(hexamethylene)triamine (pentamethylene phosphonic acid) (HO)2POCH2N[(CH2)6N[CH2PO(OH)2]2]-2, and phosphorus acid H3PO3. Exemplary amino-carboxylates include aminocarboxylic acids such as N-hydroxyethylimino diacetic acid, nitrilotriacetic acid (NTA), ethylenediaminetetraacetic acid (EDTA), methylglycinediacetic acid (MGDA), N-hydroxyethyl-ethylenediaminetriacetic acid (DTPA).

The composition may comprise about 1 to about 30 wt-%, or about 2 to about 25 wt-%, or about 3 to about 20 wt-%, or about 4 to about 16 wt-%, or about 5 to about 15 wt-%, or about 7 to about 13 wt-%, or about 9 to about 11 wt-% of chelating agent. In an exemplary embodiment, the composition comprises about 8, 10, or 12 wt-% of a chelating agent, such as EDTA.

According to an embodiment, the composition comprises an acid. Suitable acids include organic acids and inorganic acids and their combinations. Any suitable acid can be selected. However, in a preferred embodiment, the acid is solid at room temperature if the composition is provided as a solid. Alternatively, a salt of an acid otherwise liquid at room temperature can be used. In a liquid composition, acids that are liquids at room temperature or that are water soluble are also useful.

In at least some embodiments the composition comprises one or more surfactants, one or more chelating agents, and one or more acids. In an embodiment, the acid is an organic acid selected from citric, formic, isocitric, tartaric, malic, monohydroxyacetic, acetic, and gluconic acid, and mixtures and salts thereof. But, any acid may be used including organic and inorganic acids. Exemplary inorganic acids include sulfuric, sulfamic, hexafluorosilicic, methylsulfamic, hydrochloric, and nitric. Exemplary organic acids include hydroxyacetic (glycolic), citric, lactic, formic, acetic, propionic, butyric, valeric, caproic, gluconic, itaconic, trichloroacetic, urea hydrochloride, and benzoic. Organic dicarboxylic acids can also be used such as oxalic, maleic, fumaric, adipic, and terephthalic acid. Peracids such as peroxyacetic acid and peroxyoctanoic acid may also be used. Any combination of these acids may also be used. According to a preferred embodiment, the acid does not include phosphoric acid.

The concentration of acid in the composition may be adjusted based on the strength of the acid selected. For example, a solid composition formulated with citric acid or another acid of similar strength may comprise about 5 to about 50 wt-%, or about 10 to about 45 wt-%, or about 20 to about 42 wt-%, or about 30 to about 40 wt-% of acid. In an exemplary embodiment, the composition comprises about 32, 35, or about 38 wt-% of citric acid. Other suitable acids for solid compositions include, for example, sodium fluorosilicate, sodium bisulfate, and sulfamic acid. Suitable acids for liquid compositions include, for example, citric acid, formic acid, and hexafluorosilicic acid.

The composition can be formulated as a solid, such as a powder, granules, pellets, tablets, or other flowable solid. In a preferred embodiment the composition is formulated as a flowable powder or granules. In at least some embodiments, the composition can be formulated as a solid by using a solidification agent. Exemplary inorganic solidification agents include phosphate salts (e.g., alkali metal phosphate), sulfate salts (e.g., magnesium sulfate, sodium sulfate or sodium bisulfate), acetate salts (e.g., anhydrous sodium acetate), borates (e.g., sodium borate), silicates (e.g., the precipitated or fumed forms) (e.g., SIPERNAT 50® available from Evonik Degussa), carbonate salts (e.g., calcium carbonate or carbonate hydrate), other known hydratable compounds, mixtures thereof, and the like.

Exemplary organic solidification agents include solid polyethylene glycol (PEG), solid polypropylene glycol, solid EO/PO block copolymer, amide, urea (also known as carbamide), nonionic surfactant (which can be employed with a coupler), starch that has been made water-soluble (e.g., through an acid or alkaline treatment process), cellulose that has been made water-soluble, inorganic agents, poly(maleic anhydride/methyl vinyl ether), polymethacrylic acid, other generally functional or inert materials with high melting points, mixtures thereof, and the like.

Suitable solid polyethylene glycols are commercially available, for example, under the tradename CARBOWAX® from Union Carbide.

Exemplary amide solidification agents include stearic monoethanolamide, lauric diethanolamide, stearic diethanolamide, stearic monoethanol amide, cocodiethylene amide, an alkylamide, mixtures thereof, and the like.

Exemplary nonionic surfactant solidification agents include nonylphenol ethoxylate, linear alkyl alcohol ethoxylate, ethylene oxide/propylene oxide block copolymer, mixtures thereof, or the like. Commercially available ethylene oxide/propylene oxide block copolymers include PLURONIC® 108 and PLURONIC® F68, available from BASF. In some embodiments, the nonionic surfactant can be selected to be solid at room temperature or the temperature at which the composition will be stored or used. In other embodiments, the nonionic surfactant can be selected to have reduced aqueous solubility in combination with the coupling agent. Suitable couplers that can be employed with the nonionic surfactant solidification agent include propylene glycol, polyethylene glycol, mixtures thereof, or the like.

In some embodiments, the compositions include any agent or combination of agents that provide a requisite degree of solidification, flowability, ease of packing, and aqueous solubility. A solid composition according to the present disclosure may encompass a variety of forms including, for example, blocks, pellets, tablets, granules, or powder. It should be understood that the term "solid" refers to the state of the detergent composition under the expected conditions of storage and use of the composition. In general, it is expected that the composition will remain a flowable solid when provided at a temperature of up to about 100° F. and preferably up to 120° F. or higher (e.g., up to 180° F.). The composition may comprise about 10 to about 40 wt-%, about 15 to about 32 wt-%, or about 20 to about 28 wt-% of solidification agents. In one embodiment the solidification agent is fumed silica. In an exemplary embodiment, the composition comprises about 22-26 wt-% fumed silica. Other possible solidification agents include, for example, bentonite clay and Laponite synthetic clay (available from BYK Additives, Inc., in Gonzales, Tex.). Bentonite and/or Laponite can be included at about 50 to 90 wt-% of the composition.

The composition may be formulated with any suitable combination of surfactants, chelating agents, acid, and optionally solidifying agent and other additional components that produce the desired effect of reducing or eliminating stains caused by sunscreen. Exemplary compositions according to the present disclosure are shown in TABLE 1.

TABLE 1

Exemplary Compositions.

| Component | Composition I (wt-%) | Composition II (wt-%) | Composition III (wt-%) | Composition IV (wt-%) |
|---|---|---|---|---|
| Nonionic surfactant | 0-10 | 20-40 | 35-60 | 22-28 |
| Anionic surfactant | 20-30 | 5-10 | 0-8 | 2-8 |
| Chelating Agent | 8-18 | 6-14 | 4-12 | 8-12 |
| Acid | 25-40 | 20-38 | 14-25 | 32-38 |
| Solidifying Agent | 30-45 | 20-30 | 10-25 | 20-28 |
| Other components | 0-5 | 1-5 | 0-3 | 0.1-2 |

In one embodiment, the composition comprises about 20-30 wt-% nonionic surfactants, about 2-10 wt-% anionic surfactants, about 7-13 wt-% chelating agents, about 30-40 wt-% acid or urea, about 15-35 wt-% solidification agent, and up to about 5% of other functional ingredients. The chelating agent may be, for example, EDTA or another chelating agent with similar functionality. The acid may be, for example, citric acid or another solid acid that results in suitable acidity of a use solution prepared from the composition. In an embodiment, a use solution prepared by dissolving the composition in water has a pH of less than 7, less than 6, less than 5, or less than 4, but higher than 1, or higher than 2. In a preferred embodiment, the use solution has a pH of about 3 to about 5. The solidification agent may be, for example, fumed silica, or another solidification agent that results in a flowable solid composition. The other functional ingredients may include, for example, a bleaching agent, an optical whitener, a de-foaming agent, a dye, and/or a perfume.

The composition may optionally include one or more additional functional ingredients including but not limited to pH modifiers, buffers, water conditioning agents, defoaming agents, bleaching agents, optical brighteners, stabilizing agents, hydrotropes or coupling agents, dyes or pigments, and perfumes.

While the composition may include one or more acids, the composition may further include other pH modifiers that adjust the pH of the use solution when the composition is dissolved. Alternatively, the pH modifiers (including the one or more acids) can be dosed as separate components into the use solution. The pH of the use solution may be adjusted to provide optimal de-staining and/or detersive activity, and may be optimized based on various factors, such as water hardness and other components included in the composition. For example, the pH of the use solution may be from about 2 to about 7, from about 2.5 to about 6.5, from about 3 to about 6, or from about 3.5 to about 5. In an embodiment, the pH of the use solution is acidic (i.e., less than 7). In a preferred embodiment, the pH of the use solution is 6 or less. Suitable pH modifiers include bases and acids, such as alkali metal hydroxides (e.g., sodium hydroxide or potassium hydroxide), organic and inorganic acids.

The composition may comprise one or more defoaming agents. Suitable defoaming agents include, for example, silicones, aliphatic acids or esters; alcohols; sulfates or sulfonates; amines or amides; vegetable oils, waxes, mineral oils as well as their sulfated derivatives; fatty acid soaps such as alkali, alkaline earth metal soaps; and mixtures thereof. Examples of suitable silicone defoaming agents include dimethyl silicone, glycol polysiloxane, methylphenol polysiloxane, trialkyl or tetraalkyl silanes, and hydrophobic silica defoamers, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. The defoaming agents can be present at a concentration of about 0.01 wt-% to 5 wt-%, about 0.05 wt-% to 2 wt-%, or about 0.1 wt-% to about 1 wt-%. Commercially available defoaming agents include Y14865 or SAG™ 30 available from Momentive Performance Materials Inc. in Waterford, N.Y.

The composition may optionally comprise one or more optical brighteners. Optical brighteners are also referred to as fluorescent whitening agents or fluorescent brightening agents that provide optical compensation for the yellow cast in fabric substrates. Optical brighteners absorb light in the ultraviolet range 275 through 400 nm and emit light in the ultraviolet blue spectrum, about 400-500 nm.

Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in detergent compositions will depend upon a number of factors, such as the type of detergent, the nature of other components present in the detergent composition, the temperature of the wash water, the degree of agitation, and the ratio of the material washed to the tub size. The brightener selection is also dependent upon the type of material to be cleaned, e.g., cottons, synthetics, etc. Since most laundry detergent products are used to clean a variety of fabrics, the detergent compositions can be formulated to contain a mixture of brighteners that are effective for a variety of fabrics.

Optical brighteners useful in the present composition can be classified into subgroups including derivatives of stilbene, pyrazoline, coumarin, carboxylic acid, methinecyanines, dibenzothiophene-5,5-dioxide, azoles, 5- and 6-membered-ring heterocycles, and other miscellaneous agents. Stilbene derivatives which may be useful in the present composition include derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Various dyes, pigments, perfumes, and other aesthetic enhancing agents may optionally be included in the composition. Dyes may be included to alter the appearance of the composition, as for example, Direct Blue 86 (available from Miles, Inc.), Fastusol Blue (available from Mobay Chemical Corp.), Acid Orange 7 (available from American Cyanamid Company), Basic Violet 10 (available from Sandoz), Acid Yellow 23 (available from GAF), Acid Yellow 17 (available from Sigma Chemical), Sap Green (available from Keystone Aniline Corporation in Chicago, Ill.), Metanil Yellow (available from Keystone Aniline Corp.), Acid Blue 9 (available from Hilton Davis), Sandolan Blue/Acid Blue 182 (available from Sandoz), Hisol Fast Red (available from Capitol Color and Chemical), Fluorescein (available from Capitol Color and Chemical), Acid Green 25 (available from Ciba-Geigy), and the like.

Fragrances or perfumes that may be included in the compositions include, for example, terpenoids such as citronellol, aldehydes such as amyl cinnamaldehyde, a jasmine such as CIS-j asmine or jasmal, SZ-6929 (commercially available from Sozio Fragrance), vanillin, and the like. The composition may comprise about 0.001 to about 5 wt-%, or about 0.01 to about 2 wt-% of dyes and/or fragrances.

The present disclosure provides a method for manufacturing a solid detergent composition. According to an embodiment, surfactant, chelating agent, acid, and other components and/or additives, as desired, are mixed together in a mixing system. The ingredients may be in the form of a liquid or a solid such as a dry particulate, and may be added to the mixture separately or as part of a premix with another ingredient. A mixing system can be used to provide for continuous mixing of the ingredients at high shear to form a substantially homogeneous liquid or semi-solid mixture in which the ingredients are distributed throughout its mass. The mixing system may be, for example, a continuous flow mixer or a single or twin screw extruder apparatus.

The mixture can be processed at a temperature to maintain the physical and chemical stability of the ingredients, preferably at temperatures of about 20-80° C. Optionally, the temperature of the mixture may be increased, for example, at the inlets or outlets of the mixing system. Heat may be applied from an external source to facilitate processing of the mixture.

The ingredients are mixed to form a substantially homogeneous consistency wherein the ingredients are distributed substantially evenly throughout the mass. The mixture can then be discharged from the mixing system through a die or other shaping means. The extrudate then can be divided into useful sizes, such as granules, pellets, tablets, or powder. The granules, pellets, tablets, or powder can optionally be packaged into unit dose packages or multiple dose packages. The packaging material can be provided as a water soluble packaging material, such as a water soluble packaging film. An exemplary water soluble polymer that can be used to package the composition includes polyvinyl alcohol. Other suitable water soluble components include water soluble polymers include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, and hydroxyethyl methylcellulose.

In the case of unit dose packages, it is expected that a single packaged unit will be placed in a washing machine and will be used up during a single wash cycle. Alternatively a unit dose package can be dissolved in and diluted with a solvent (e.g., water) to be used for spot cleaning or surface cleaning, or used as a pre-treatment or booster. In the case of a multiple dose package, the unit may be placed in a detergent or wash compartment, where a stream of water will degrade a surface of the concentrate to provide a liquid concentrate that will be introduced into the washing machine.

According to embodiments of the method, the composition is dosed into water or other aqueous media to produce a use solution, and the use solution is used to treat the textile. The composition can be dosed as a solid composition (e.g., a premixed mixture of components provided as a solid composition), as a liquid composition (e.g., a premixed mixture of liquid components), or as separate liquid and/or solid components that are dosed together or sequentially. The term "use solution" is used here to refer to the solution produced by dissolving the concentrate (either a solid composition, a liquid composition, or solid and/or liquid components) for contact with the articles to be treated. The use solution can be prepared at the location of use. When the composition is used in a washing machine, it is expected that the composition is dissolved and diluted in the washing machine before or during an automated wash cycle. When the composition is used in a residential or home-style washing machine, the composition can be placed in the detergent compartment or the wash compartment of the washing machine. The composition can be provided in the form that allows for introduction of a single dose of the solid detergent composition into the compartment. In an industrial laundry setting, the composition can be proved as a solid or as a liquid, or as liquid and/or solid components that are dosed separately. The dosing can be done manually or by an automated system. The composition can be provided so that de-staining and/or detergency properties are provided when the composition is mixed with either hard or soft water.

In an embodiment, the method comprises at least a treatment cycle, where a use solution of the composition is used to treat the textile, and one or more rinse cycles. In another embodiment, the method further comprises one or more wash cycles, where the textile is washed with a laundry detergent, and optionally a bleach cycle, where the textile is treated with a conventional bleaching agent. The different treatment and wash cycles may be separated by rinse cycles. In an exemplary embodiment, the method includes (1) a treatment cycle with the present composition; and (2) a rinse cycle. In another exemplary embodiment, the method includes (1) a treatment cycle with the present composition; (2) a wash cycle with neutral detergent; and (3) a rinse cycle. In yet another exemplary embodiment, the method includes (1) a treatment cycle with the present composition; (2) a wash cycle with neutral detergent; (3) a rinse cycle; (4) a wash cycle with alkaline detergent; (5) a rinse cycle; (6) a bleach cycle; and (7) one or more rinse cycles. In a preferred embodiment, the wash cycle immediately following the treatment cycle comprises use of a neutral detergent. Other combinations of various treatment, wash, bleach, and rinse cycles can be envisioned by those skilled in the art.

The composition may also be used in a tunnel washer. A typical tunnel washer includes multiple compartments, where a different cycle of a wash program is performed in each compartment. The articles to be washed are introduced at one end of the machine (e.g., through an entry hopper), and move sequentially through the various compartments. For example, the tunnel washer may include a pre-rinse compartment, one or more wash compartments, and one or more rinse compartments. Tunnel washers often utilize a counterflow system, where water used to wash and rinse the articles flows in an opposite direction of the articles being washed. Clean water can be taken in at the last rinse cycle, then used at the next-to-last rinse cycle, then in one or more wash cycles, and lastly in a pre-rinse cycle. If the composition is used as a pre-treatment, it may be dosed in at the pre-rinse compartment of a tunnel washer. On the other hand, if the composition is used as a laundry booster or as part of a detergent system, it may be dosed in during a wash cycle in a wash compartment. If the composition is dosed in as separate components, some components may be dosed in at a different cycle than other components.

The amount of composition dosed depends at least partially on the concentration of active components in the concentrate composition. The dosing amount can be calculated based on a desired final concentration in the use solution used to treat textiles. In practice, because a solid composition can be made to include a higher concentration of active ingredients, the dosing amounts can also be higher. Examples of concentration ranges in use solutions are shown in TABLE 2 below. The term liquid system is used to refer to a use solution, where the composition is dosed as liquids. The term solid system is used to refer to a use solution, where the composition is dosed as solids.

TABLE 2

Exemplary Use Solution Concentrations.

| Component | Range I (ppm) | Range II (ppm) | Range III (ppm) | Range IV (ppm) | Range V (ppm) |
|---|---|---|---|---|---|
| Liquid System | | | | | |
| Surfactant | 300-2300 | 400-1500 | 500-1000 | 600-800 | 650-750 |
| Chelating Agent | 200-1000 | 300-800 | 350-600 | 400-550 | 450-500 |
| Acid | 300-2700 | 400-1500 | 500-1000 | 550-700 | 600-650 |
| Solid System | | | | | |
| Surfactant | 650-3500 | 1500-3000 | 1800-2700 | 2000-2400 | 2100-2300 |
| Chelating Agent | 300-1500 | 400-1200 | 500-1000 | 600-900 | 650-750 |
| Acid | 600-4000 | 1200-3500 | 1800-3000 | 2200-2800 | 2400-2700 |

In an exemplary liquid system, the chelating agent is EDTA (a suitable commercially available solution, such as 40 wt-%, can be used), the surfactant is a blend of anionic and/or nonionic surfactants (a suitable commercially available blend, such as Ecolab's Low Temperature Laundry Detergent, can be used), and the acid is a blend of acids, e.g., citric and hexafluorosilicic acids (a suitable commercially available blend, such as Ecolab's Eco-Star/Tri-Star Sour VII, can be used).

In an exemplary solid system, the chelating agent is a solid EDTA, the surfactant is a blend of anionic and/or nonionic surfactants (a suitable blend of commercially available surfactants, such as BARLOX®, LUTENSOL®, and SURFONIC® (see sourcing in Examples) can be used), and the acid is citric acid.

The amount of acid dosed into the use solution is mainly determined by the desired pH level of the use solution. In some embodiments, the pH of the use solution is from about 2 to about 7, from about 2.5 to about 6.5, from about 3 to about 6, or from about 3.5 to about 5.

In an exemplary embodiment the concentrate composition is provided as a solid composition, and the concentrate can be diluted at a ratio of water to concentrate of at least about 50:1, or between about 50:1 to 1000:1, about 50:1 to 500:1, about 75:1 to 200:1, or between about 100:1 to 150:1, to provide a use solution having the desired concentration ranges of active components and desired properties (e.g., stain removal capability).

If the composition is used in a wash cycle of a washing machine, the wash cycle can be run for about 10 to 120 minutes, about 20 to 110 minutes, or about 60 to 90 minutes. In a preferred embodiment, the wash cycle is at least 40 minutes, or at least 60 minutes. If a tunnel washer is used, the length of the wash cycle is typically shorter, but the program may include multiple wash cycles. The temperature of the use solution during the wash cycle can be about 100° F. or more, or about 110° F. or more, or about 120° F. or more. In some embodiments, the temperature is between 100 and 160° F., between 110 and 150° F., or between about 120 and 140° F.

According to embodiments, the composition is capable of eliminating or reducing colored stains caused by sunscreen, such as sunscreen containing avobenzone and/or oxybenzone. Avobenzone and oxybenzone stains are usually yellow or orange in color. The color of an item, e.g., a textile, can be measured using a colorimeter. Color can expressed on various scales, such as the L*a*b* scale, where b* refers to the yellow-blue scale, and where higher b* values indicate more yellow, and lower b* values less yellow. Typically, a difference of about 1-2 in b* is discernible to the naked eye (i.e., the average person can tell the difference between b* values that are at least 1-2 units apart). To evaluate the stain-removing power of the composition, the b* value of the textile after stain removal ("b* after") can be compared to the b* value before the textile was stained ("b* before"). In an ideal case, b*-after is very close to or the same as b*-before, meaning that the treatment has returned the textile to its original condition or very close to its original condition. In other words, the change in b* (Δb*) is minimal between b*-before and b*-after. According to an embodiment, the composition is capable of at least partially removing stains so that Δb* is 6 or less, 5 or less, 4 or less, 3 or less, or 2 or less. In one embodiment, Δb* is between 0 and about 4, or between 0 and 3, or between 0 and 2.

As used herein, "weight percent," "wt-%," "percent by weight," "% by weight," and variations thereof refer to the concentration of a substance as the weight of that substance in relation to the total weight of the composition. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The following examples and test data provide an understanding of certain specific embodiments of the invention. The examples are not meant to limit the scope of the invention that has been set forth in the foregoing description. Variations within the concepts of the invention are apparent to those skilled in the art.

EXAMPLES

Removal of three different levels of sun screen stains was tested using two compositions and wash procedures according to the present disclosure (Examples A and B), and two existing compositions and wash procedures (Examples C and D). The effectiveness of the treatments was evaluated by determining the change in the color yellow as compared to control samples that were not treated. The color was measured using a colorimeter to measure b* on the L*a*b* scale, where b* refers to the yellow-blue scale. Higher b* values indicate more yellow, and lower b* values less yellow. The amount of yellow (b*) after washing was compared to the amount of yellow before the samples were stained and was reported as Δb*. A low Δb* indicates that the sample was returned to close to its original state after treatment, whereas a high Δb* indicates that the yellow stain was present after treatment.

Equipment:

A 35 lb UNIMAC washing machine was used to wash and treat the samples. Samples were washed along with a 28 lb cotton terry load using 5 grain water.

A Hunter Colorimeter was used to measure b*.

Chemicals:

COPPERTONE® ultraGUARD® is available from Bayer Corp., Robinson Township, Pa.

L2000XP is available from Ecolab, Inc., in St Paul, Minn.

TRISTAR® Laundri Destainer is available from Ecolab.

BARLOX® 12 is available from Lonza Inc. in Allendale, N.J.

LAS is used to refer to linear alkylbenzene sulfonate.

LUTENSOL XP 50 is available from BASF Corp., in Florham Park, N.J.

SURFONIC L24-7 is available from Huntsman Corp., in The Woodlands, Tex.

Y14865 antifoam is available from Momentive in Columbus, Ohio

SIPERNAT® 22 is available from Evonik Degussa Corp. in Cincinnati, Ohio

ECO-STAR® Sour VII is available from Ecolab.

Water Treatment MC is available from Ecolab.

Royal Performance Detergent is available from Ecolab.

ECO-STAR® Builder C is available from Ecolab.

Solid Surge Plus is available from Ecolab.

Solid Destainer is available from Ecolab.

Solid Clearly Soft is available from Ecolab.

Preparation of Test Samples:

Test samples with three levels of yellow stains from sunscreen were prepared by coating 2 inch by 3 inch cotton terry swatches with (1) 0.5 g of 30 SPF sunscreen lotion (COPPERTONE ULTRAGUARD); (2) 0.5 g of 70 SPF sunscreen lotion (COPPERTONE ULTRAGUARD); or (3) 1.0 g of 70 SPF sunscreen lotion (COPPERTONE ULTRAGUARD).

The swatches were allowed to sit overnight, followed by a typical alkaline wash with bleach. The following sample preparation wash procedure was used:

1. (Wash cycle) Machine was filled with a low level of water at 120° F. and 98 g of alkaline laundry detergent (L2000XP). pH of the solution was approximately 11.5. Swatches were washed for 7 min and drained for 2 min.
2. (Rinse cycle) Machine was filled with a high level of water at 120° F. Swatches were washed for 2 min and drained for 2 min.
3. (Bleach cycle) Machine was filled with a low level of water at 120° F. and 28 g of chlorine bleach (TRISTAR Laundri Destainer). Swatches were washed for 7 min and drained for 2 min.
4. (Rinse cycle) Machine was filled with a high level of water at 105° F. Swatches were washed for 2 min and drained for 2 min. Cycle was repeated three more times.
5. (Spin cycle) Water was extracted at 400 rpm for 5 minutes.

The swatches were allowed to air dry. The color (b*) of the stains was measured using the colorimeter. The color measurements of three swatches at each staining level were averaged. Results are shown in TABLE 3 below. Stained samples without additional treatment were used as control samples.

TABLE 3

| Control Samples | |
|---|---|
| Sample | Δb* |
| 0.5 g SPF 30 | 13.0 |
| 0.5 g SPF 70 | 25.4 |
| 1.0 g SPF 70 | 26.7 |

As can be seen in the results in TABLE 3, the typical alkaline treatment left strong yellow stains on the control samples.

Example A

Nine pre-stained swatches were washed using Composition A (shown in TABLE 4 below).

TABLE 4

| Composition A | | |
|---|---|---|
| Component | Amount in Composition (wt-%) | Amount (g) |
| Chelating agent (tetrasodium EDTA) | 20 | 90.8 |
| Nonionic surfactant (cocoamine oxide, BARLOX 12) | 6.6 | 30.0 |
| Anionic surfactant (LAS) | 6.6 | 30.0 |
| Nonionic surfactant (LUTENSOL XP 50) | 13.3 | 60.4 |
| Nonionic surfactant (SURFONIC L24-7) | 13.3 | 60.4 |
| Citric acid | 40 | 181.6 |
| Antifoaming agent (Y14865) | 0.2 | 0.9 |

1. (Wash cycle) Machine was filled with a low level of water at 125° F. and 1 lb (about 454 g) of Composition A. pH of the solution was approximately 3-5. Swatches were washed for 60 min and drained for 1 min.
2. (Rinse cycle) Machine was filled with a high level of water at about 105° F. Swatches were washed for 2 min and drained for 1 min. Cycle was repeated four more times.
3. (Spin cycle) Water was extracted at 400 rpm for 6 minutes.

The swatches were allowed to air dry. The color (*b) of the stains was measured using the colorimeter. The b* value was compared to the b* value before staining to yield Δb*. The results are shown in TABLE 6.

Example B

Nine pre-stained swatches were washed using Composition B (shown in TABLE 5 below). The composition was prepared with a silica carrier, making it a flowable granular powder.

TABLE 5

| Composition B | | |
|---|---|---|
| Component | Amount in Composition (wt-%) | Amount (g) |
| Chelating agent (tetrasodium EDTA) | 10 | 68.1 |
| Nonionic surfactant (cocoamine oxide, BARLOX 12) | 5 | 34.1 |
| Anionic surfactant (LAS) | 5 | 34.1 |
| Nonionic surfactant (LUTENSOL XP 50) | 10 | 68.1 |
| Nonionic surfactant (SURFONIC L24-7) | 10 | 68.1 |
| Citric acid | 35.6 | 242.4 |
| Antifoaming agent (Y14865) | 0.4 | 2.7 |
| Silica carrier (SIPERNAT 22) | 24 | 163.4 |

Composition B was prepared by mixing the ingredients together.

1. (Wash cycle) Machine was filled with a low level of water at 125° F. and 1.5 lb (about 680 g) of Composition B. pH of the solution was approximately 3-5. Swatches were washed for 60 min and drained for 1 min.
2. (Rinse cycle) Machine was filled with a high level of water at about 105° F. Swatches were washed for 2 min and drained for 1 min. Cycle was repeated four more times.
3. (Spin cycle) Water was extracted at 400 rpm for 6 minutes.

The swatches were allowed to air dry. The color (*b) of the stains was measured using the colorimeter. The b* value was compared to the b* value before staining to yield Δb*. The results are shown in TABLE 6.

Example C

Nine pre-stained swatches were washed using a liquid chemical wash. The composition was added as separate liquid components.

1. (Treatment cycle) Machine was filled with a low level of water at 125° F. and 41.1 g of laundry sour (ECO-STAR Sour VII, containing fluorosilicic acid and citric acid) and 78.3 g water conditioner (Water Treatment MC, containing EDTA and NaOH). pH of the solution was approximately 3-5. Swatches were washed for 6 min and drained for 1 min.
2. (Wash cycle) Machine was filled with a low level of water at 125° F. and 62.1 g of neutral laundry detergent (Royal Performance). Swatches were washed for 10 min and drained for 1 min.
3. (Rinse cycle) Machine was filled with a low level of water at 125° F. Swatches were washed for 2 min and drained for 1 min.
4. (Alkaline cycle) Machine was filled with a low level of water at 125° F. and 91.3 g of alkaline builder (ECO-STAR Builder C). pH of the solution was approximately 11.5. Swatches were washed for 8 min and drained for 1 min.
5. (Rinse cycle) Machine was filled with a low level of water at 125° F. Swatches were washed for 2 min and drained for 1 min.
6. (Bleach cycle) Machine was filled with a low level of water at 125° F. and 72 g of chlorine bleach (TRISTAR Laundri Destainer). Swatches were washed for 7 min and drained for 1 min.
7. (Rinse cycle) Machine was filled with a high level of water at 125° F. Swatches were washed for 2 min and drained for 1 min.
8. (Rinse cycle) Machine was filled with a high level of water at about 105° F. Swatches were washed for 2 min and drained for 1 min. Cycle was repeated one more time.
9. (Treatment cycle) Machine was filled with a low level of water at about 105° F. and 41.1 g of laundry sour (ECO-STAR Sour VII, containing fluorosilicic acid and citric acid) and 78.3 g water conditioner (Water Treatment MC, containing EDTA and NaOH). pH of the solution was approximately 3-5. Swatches were washed for 6 min and drained for 1 min.
10. (Spin cycle) Water was extracted at 400 rpm for 5 minutes.

The swatches were allowed to air dry. The color (*b) of the stains was measured using the colorimeter. The b* value was compared to the b* value before staining to yield Δb*. The results are shown in TABLE 6.

Example D

Nine pre-stained swatches were washed using a liquid chemical wash. The treatment cycles did not include EDTA.

1. (Treatment cycle) Machine was filled with a low level of water at 104° F. and 75.8 g of laundry sour (ECO-STAR Sour VII, containing fluorosilicic acid and citric acid). pH of the solution was approximately 3-5. Swatches were washed for 10 min and drained for 1 min.
2. (Wash cycle) Machine was filled with a low level of water at 104° F. and 35 g of solid alkaline laundry detergent (Surge Plus). pH of the solution was approximately 11.5. Swatches were washed for 10 min and drained for 1 min.
3. (Bleach cycle) Machine was filled with a low level of water at 104° F. and 6.3 g of solid chlorine bleach (Solid Destainer). Swatches were washed for 10 min and drained for 1 min.
4. (Spin cycle) Water was extracted at 400 rpm for 5 minutes.
5. (Treatment cycle) Machine was filled with a high level of water at 104° F. and 75.8 g of laundry sour (ECO-STAR Sour VII, containing fluorosilicic acid and citric acid). Swatches were washed for 2 min. 23.1 g of solid fabric softener (Solid Clearly Soft) was added to the solution. pH of the solution was approximately 3-5. Swatches were further washed for 5 min and drained for 1 min.
6. (Spin cycle) Water was extracted at 400 rpm for 5 minutes.

The swatches were allowed to air dry. The color (*b) of the stains was measured using the colorimeter. The b* value was compared to the b* value before staining to yield Δb*. The results are shown in TABLE 6.

Results from Examples A-D

TABLE 6

| Results, Examples A-D and Control Sample | | | |
|---|---|---|---|
| Treatment | 0.5 g SPF 30 (Δb*) | 0.5 g SPF 70 (Δb*) | 1.0 g SPF 70 (Δb*) |
| Control (wash only, no treatment) | 13.0 | 25.4 | 26.7 |
| Example A | 3.0 | 4.3 | 4.3 |
| Example B | 3.3 | 3.7 | 4.5 |

TABLE 6-continued

| Results, Examples A-D and Control Sample | | | |
|---|---|---|---|
| Treatment | 0.5 g SPF 30 (Δb*) | 0.5 g SPF 70 (Δb*) | 1.0 g SPF 70 (Δb*) |
| Example C | 3.9 | 4.7 | 5.2 |
| Example D | 10.0 | 12.6 | 12.6 |

It was found that the compositions and methods according to the present disclosure were able to remove nearly all of the staining on the samples. Each of the compositions that included surfactant, chelating agent, and acid (Examples A-C) produced a Δb* of less than 4 for the lightest stains, less than 5 for the medium level stains, and 5.2 or less for the strongest stains. Example D, which did not include a chelating agent, performed better than the control, but was not as effective against the stains as Examples A-C. The results of Composition B (Example B) showed that the composition could be formulated with a silica carrier to produce a convenient granular powder, while retaining its effectiveness.

What is claimed is:

1. A method for treating a stain caused by sunscreen lotion on a textile, the method comprising:

(a) preparing a use solution by diluting a flowable solid composition with water, the flowable solid composition comprising:

i) about 20 to about 50 wt-% of one or more surfactants comprising a nonionic surfactant and an anionic surfactant, wherein at least 3 parts of nonionic surfactant are present for every 1 part of anionic surfactant, ii) about 4 to about 25 wt-% of one or more chelating agents selected from the group consisting of a phosphate, phosphonate, amino-carboxylate, or combination thereof, iii) a solidification agent comprising fumed silica, and iv) about 25 to about 50 wt-% of an acid or a salt thereof, the acid being different from the chelating agent and being selected from the group consisting of glycolic acid, citric acid, lactic acid, formic acid, acetic acid, propionic acid, butyric acid, valeric acid, caproic acid, gluconic acid, itaconic acid, trichloroacetic acid, benzoic acid, urea hydrochloride, and combinations thereof, wherein the use solution has a pH of less than 7 and comprises about 300-3500 ppm of the one or more surfactant, about 200-1500 ppm of the one or more chelating agent, and about 300-4000 ppm of the acid or its salt;

(b) applying the use solution to the textile, wherein the textile is contaminated with sunscreen comprising avobenzone, oxybenzone, or a combination thereof; and (c) rinsing the textile, wherein the method is capable of reducing sunscreen stains caused by the avobenzone or oxybenzone in textiles to a Δb* of 7 or less as compared to the textile before staining.

2. The method of claim 1, wherein the surfactants comprise about 2 to about 10% anionic surfactants and about 20 to about 40% nonionic surfactants by weight of the composition.

3. The method of claim 1, wherein the acid comprises citric acid.

4. The method of claim 1, wherein the method is capable of reducing sunscreen stains in textiles to a Δb* of 5 or less as compared to the textile before staining.

5. The method of claim 1, wherein the use solution has a pH of about 3-5.

6. A composition for treating sunscreen stains caused by avobenzone or oxybenzone, the composition comprising:

i) about 15 to about 60 wt-% of a surfactant system comprising at least one nonionic surfactant and at least one anionic surfactant;

ii) about 4 to about 18 wt-% chelating agent selected from the group consisting of a phosphate, phosphonate, amino-carboxylate, or combination thereof;

iii) about 25 to about 50% of an acid comprising citric acid;

iv) a solidification agent comprising fumed silica; and v) one or more additional functional ingredients selected from the group consisting of pH modifiers, buffers, water conditioning agents, defoaming agents, bleaching agents, optical brighteners, stabilizing agents, hydrotropes, coupling agents, dyes, pigments, and perfumes, wherein the composition is a flowable solid, and wherein the composition has a pH of less than 7 when dissolved in water.

7. The composition of claim 6, wherein the composition is formulated as a powder or granules.

8. The composition of claim 6, wherein the composition is capable of reducing sunscreen stains in textiles to a Δb* of 7 or less as compared to the textile before staining.

9. The composition of claim 6, wherein the composition is capable of reducing sunscreen stains in textiles to a Δb* of 5 or less as compared to the textile before staining.

10. The composition of claim 6, wherein the composition comprises from about 10 to about 40 wt-% solidification agents.

11. The composition of claim 6, wherein the composition comprises about 22 to about 26 wt-% fumed silica.

12. The composition of claim 6, wherein the acid comprises citric acid and another acid selected from the group consisting of glycolic acid, lactic acid, formic acid, acetic acid, propionic acid, butyric acid, valeric acid, caproic acid, gluconic acid, itaconic acid, trichloroacetic acid, benzoic acid, urea hydrochloride, and combinations thereof.

13. The composition of claim 6, wherein the surfactants comprise about 2 to about 10% anionic surfactant and about 20 to about 40% nonionic surfactant by weight of the composition.

14. The composition of claim 6, wherein the chelating agent is an aminocarboxylate selected from the group consisting of N-hydroxyethylimino diacetic acid, nitrilotriacetic acid (NTA), ethylenediaminetetraacetic acid (EDTA), methylglycinediacetic acid (MGDA), and N-hydroxyethyl-ethylenediaminetriacetic acid.

15. The method of claim 1, wherein the flowable solid composition comprises about 25 to about 50% citric acid.

16. The method of claim 1, wherein the chelating agent is an aminocarboxylate selected from N-hydroxyethylimino diacetic acid, nitrilotriacetic acid (NTA), ethylenediaminetetraacetic acid (EDTA), methylglycinediacetic acid (MGDA), and N-hydroxyethyl-ethylenediaminetriacetic acid.

17. The method of claim 1, wherein the flowable solid composition comprises about 22 to about 26 wt-% fumed silica.

* * * * *